US007718206B2

(12) United States Patent
Mayr et al.

(10) Patent No.: US 7,718,206 B2
(45) Date of Patent: May 18, 2010

(54) INFUSION BAG

(75) Inventors: Peter Mayr, Trippstadt (DE); Hans Henkes, Worms (DE); Peter Müller, St. Leon-Rot (DE); Martin Büchsel, Chapel Hill, NC (US)

(73) Assignee: Carl Freudenberg KG, Weinheim (DE)

( * ) Notice: Subject to any disclaimer, the term of this patent is extended or adjusted under 35 U.S.C. 154(b) by 238 days.

(21) Appl. No.: 11/829,619

(22) Filed: Jul. 27, 2007

(65) Prior Publication Data

US 2008/0166454 A1 Jul. 10, 2008

(30) Foreign Application Priority Data

Jul. 27, 2006 (DE) ..... 10 2006 034 730

(51) Int. Cl.
*B65B 29/02* (2006.01)

(52) U.S. Cl. ..... 426/77

(58) Field of Classification Search ..... None
See application file for complete search history.

(56) References Cited

U.S. PATENT DOCUMENTS 6,458,726 B1 * 10/2002 Harrington et al. ..... 442/364
2004/0018795 A1 1/2004 Viazmensky
2005/0136155 A1 6/2005 Jordan
2008/0081090 A1 * 4/2008 Mayr et al. ..... 426/77

FOREIGN PATENT DOCUMENTS

| | | |
|---|---|---|
| DE | 19900424 | 7/2000 |
| DE | 10343032 | 5/2005 |
| DE | 69826457 | 10/2005 |
| EP | 1452633 | 1/2004 |
| EP | 1553224 | 7/2005 |
| EP | 1584723 | 10/2005 |
| JP | 2004242944 | 9/2004 |
| JP | 2004338750 | 12/2004 |
| WO | 02/48443 | 6/2002 |

* cited by examiner

*Primary Examiner*—Arti Singh-Pandey
(74) *Attorney, Agent, or Firm*—Grossman, Tucker, Perreault & Pfleger, PLLC

(57) ABSTRACT

Described is an infusion bag comprising a layer made of nonwoven fabric composed of bicomponent fibers and/or filaments composed of a high-melting component and a low-melting component, the high-melting component including a polyester. Problems in the fabrication of the nonwoven fabric are avoided by the fact that the low-melting component includes a likewise high-melting polymer having a melting point ≧200° C.

12 Claims, No Drawings

INFUSION BAG

TECHNICAL FIELD OF THE INVENTION

The invention relates to an infusion bag comprising a layer made of nonwoven fabric composed of bicomponent fibers and/or filaments composed of a high-melting component and a low-melting component, the high-melting component including a polyester.

PRIOR ART

Infusion bags of the aforementioned type are known from JP 2004338750 A and JP 2004242944 A, for example. The known infusion bags are made of a spun-bonded fabric composed of core-sheath fibers having a high-melting core component and a low-melting sheath component. The high-melting core component is composed of a polyester, in particular polyethylene terephthalate, and the low-melting sheath component is composed of polypropylene or polyethylene. The low-melting sheath component imparts heat-sealing capability to the material. According to JP 2004338750 A, the melting points of polyester and polypropylene are high enough to prevent the material from dissolving when immersed in hot water for infusing the contents. According to JP 2004242944 A, the melting point of the high-melting component should be at least 50° C. above the melting point of the low-melting component.

A disadvantage of the known infusion bags is that agglutination may occur at the material interface during fabrication.

DESCRIPTION OF THE INVENTION

The object of the invention is to refine an infusion bag of the type referenced at the outset in such a way that the above-described problems do not occur during fabrication. This object is achieved by an infusion bag comprising a layer made of nonwoven fabric composed of bicomponent fibers and/or filaments composed of a high-melting component and a low-melting component, the high-melting component including a polyester, characterized in that the low-melting component includes a likewise high-melting polymer having a melting point ≧200°C.

According to the above invention, for an infusion bag comprising a layer made of nonwoven fabric made of bicomponent fibers and/or filaments composed of a high-melting component and a low-melting component, the high-melting component including a polyester, the low-melting component includes a likewise high-melting polymer having a melting point ≧200° C.

Copolyethylene terephthalate (COPET) and/or polybutylene terephthalate (PBT) in particular may be used as sheath components. The melting point of these materials is approximately 180 to 225° C.

Polyethylene terephthalate (PET), with a much higher melting temperature of 235-265° C., is generally used as the core material.

Bicomponent fibers and/or filaments composed of CoPET/PET are known as such. They are usually used as binder fibers/filaments for many types of applications. Such fibers and/or filaments are characterized not only by extraordinary temperature stability, but also by very high rigidity, for which reason they would be expected to be unsuitable for the described application. Polyethylene and polypropylene are in fact soft materials which impart a certain flexibility to the nonwoven fabric, thereby greatly simplifying its processing into an infusion bag.

Surprisingly, it has been shown that nonwoven fabrics composed of bicomponent fibers and/or filaments of CoPET/PET or PBT/PET are easily processed despite their high rigidity. Heat sealing of the material into infusion bags may be easily carried out by impingement with thermal energy or by ultrasonic welding. The problem of smearing of the cut edges in later steps of fabrication does not occur. Furthermore, it has surprisingly been shown that the esthetic appearance of an infusion bag is significantly enhanced as a result of the high rigidity. An infusion bag according to the invention is characterized by an improved pop-up function. In other words, the infusion bag is dimensionally stable, and resumes its original shape after mechanical deformations which occur in packaging, for example.

The bicomponent fibers or filaments are preferably designed as core/sheath fibers/filaments. However, the present invention is not limited to these types of bicomponent fibers/filaments. Thus, the bicomponent fibers/filaments may be designed as side-by-side fibers, for example.

The infusion bag according to the invention is preferably made of a nonwoven fabric, which has little risk of individual fibers falling out, which may occur when staple fibers, for example, are used.

The weight per unit area of the nonwoven fabric used for the infusion bag according to the invention is preferably between 10 and 30 g/m$^2$, particularly preferably between 16 and 22 g/m$^2$. For lower weights per unit area the nonwoven fabric layer is too irregular, and for higher weights per unit area the transparency of the material is adversely affected.

The thickness of the nonwoven fabric material used is preferably between 0.05 and 0.15 mm, preferably approximately 0.07 mm. The rigidity of the material is reduced to an excessive degree when the material is too thin, and the esthetic appearance of an infusion bag made of this material is impaired. On the other hand, when the material is too thick its processibility is adversely affected.

The fiber or filament thickness of a nonwoven fabric used for the infusion bag according to the invention is preferably between 1 and 2.5 dtex, particularly preferably approximately 1.7 dtex. When the filaments or fibers are too thin the material becomes so dense that the liquid or active substance exchange is impaired. When the fibers are too thick, the active substance contained within may fall out.

The penetration rate should preferably be less than 3 percent. The penetration rate of the nonwoven fabric is understood to mean the passage or falling out of specific tea particle grain fractions through the nonwoven fabric structure. A low penetration rate means that the tea particle constituents are largely retained in the infusion bag.

The per-hole flow rate is preferably between 0.4 and 0.7 g per hole per minute. This range of per-hole flow rates has proven to be advantageous with regard to the resulting nonwoven fabric properties, penetration rates, cost-effectiveness, and processibility.

An infusion bag according to the invention is characterized by high rigidity and resistance to media. At the same time, it has a high permeability for the liquids used for the infusion bag and for the materials extracted during infusion, whereas undesired fine and extremely fine particles may be reliably retained in the bag. When smooth calender rollers are used in manufacturing the nonwoven fabric, the material is super-transparent and therefore highly suitable in particular for applications in which besides good infusion characteristics the esthetic appearance is important, for example for tea bags.

An infusion bag according to the invention is therefore preferably used for tea bags. For this application, as previously mentioned, it is advantageous to smooth-calender the nonwoven fabric used to ensure the highest possible transparency. The very pleasing esthetic appearance is further enhanced by the increased pop-up capability of the bag.

A further preferred application of the nonwoven fabric according to the invention is for use as a coffee pod. For this application, consumers generally prefer a less transparent material, which may be realized, for example, by the use of gravure rollers when calendering the nonwoven fabric.

The infusion bag according to the invention may also find general application as a container for active substances, as well as for hot and for cold applications. Thus, for example, general use in the areas of hot beverages or soft drinks is conceivable. Use for soups, for example, is also possible. Infusion bags according to the invention may also find application for medicinal baths, such as chamomile baths. However, the infusion bag according to the invention is not limited to the described applications.

What is claimed is:

1. Infusion bag comprising a layer made of nonwoven fabric composed of bicomponent fibers and/or filaments composed of a high-melting component and a low-melting component, the high-melting component including a polyester having a melting point in the range of about 235-265° C., and the low-melting component includes a polymer having a melting point ≧200° C., where in the high-melting component comprises polyethylene terephthalate (PET) and the low-melting component comprises copolyethylene terephthalate (CoPET) and/or polybutylene terephthalate (PBT).

2. Infusion bag according to claim 1, characterized in that the bicomponent fibers/filaments are designed as core/sheath fibers/filaments.

3. Infusion bag according to claim 1, characterized in that the nonwoven fabric is a spun-bonded fabric.

4. Infusion bag according to claim 1, characterized in that the weight per unit area of the layer is 10 to 30 g/m$^2$.

5. Infusion bag according to claim 1, characterized in that the thickness of the layer is 0.05 to 0.15 mm.

6. Infusion bag according to claim 1, characterized in that the fiber/filament thickness is 1 to 2.5 dtex.

7. Infusion bag according to claim 1, characterized in that the penetration rate is <3%.

8. Infusion bag according to claim 1, characterized in that the per-hole flow rate is 0.4-0.7 g/(hole-minute).

9. Infusion bag according to claim 1, characterized in that the nonwoven fabric is smooth-calendered.

10. Infusion bag according to claim 1, characterized in that the nonwoven fabric is calendered by use of a gravure roller.

11. The infusion bag according to claim 1 wherein said bag comprises a container for active substances.

12. The infusion bag according to claim 11 wherein said active substances comprise tea or coffee.

* * * * *